US005520073A

United States Patent [19]

Bakula et al.

[11] Patent Number: 5,520,073

[45] Date of Patent: May 28, 1996

[54] REVERSIBLE RATCHETING SCREWDRIVER WITH SPINNER AND ERGONOMIC HANDLE

[75] Inventors: Gerald R. Bakula; Daniel M. Eggert, both of Kenosha; Christopher D. Thompson, Milwaukee; Gerald L. Socha, Kenosha, all of Wis.

[73] Assignee: Snap-on Incorporated, Kenosha, Wis.

[21] Appl. No.: 395,063

[22] Filed: Feb. 27, 1995

[51] Int. Cl.[6] ..... B25B 13/46

[52] U.S. Cl. ..... 81/63.1; 81/58.1; 81/63.2

[58] Field of Search ..... 81/58.1, 63.1, 81/62, 490, 60–61

[56] References Cited

U.S. PATENT DOCUMENTS

| | | | |
|---|---|---|---|
| 2,404,092 | 7/1946 | Reynolds . | |
| 2,612,807 | 10/1952 | Hunt . | |
| 2,672,066 | 3/1954 | Sandrock et al. . | |
| 2,712,765 | 7/1955 | Knight, Jr. | 81/177.1 |
| 2,982,160 | 5/1961 | Little . | |
| 3,691,876 | 9/1972 | Cassidy, Jr. | 81/58.1 |
| 3,783,703 | 1/1974 | Trimble et al. | 81/58.1 |
| 4,621,718 | 11/1986 | DeCarolis | 81/63.1 |
| 4,777,852 | 10/1988 | Herman et al. . | |
| 4,793,222 | 12/1988 | Beugelsdyk | 81/63.1 |
| 4,799,407 | 1/1989 | Miyamoto . | |
| 4,807,500 | 2/1989 | Main | 81/63.1 |
| 5,142,953 | 9/1992 | Lin | 81/63.2 |
| 5,211,086 | 5/1993 | Shu | 81/58.1 |
| 5,437,212 | 8/1995 | Thompson et al. | 81/63.1 |

OTHER PUBLICATIONS

Snap–on Incorporated 1994 Catalog, pp. 45 (item P) and 83 (item X).

*Primary Examiner*—Willis Little
*Attorney, Agent, or Firm*—Emrich & Dithmar

[57] ABSTRACT

The ratcheting screwdriver comprises a handle with a working end and a reversible ratchet mechanism therein, the ratchet mechanism defining a bore which receives one end of an associated shank coaxially therein. A cup-shaped reversing member is coupled to the handle for limited rotational movement relative thereto and has an annular flange projecting a slight distance radially therebeyond and engageable by a finger and/or thumb of a user's hand which is gripping the handle for shifting the ratchet mechanism between forward ratcheting, reverse ratcheting and non-ratcheting modes. A cup-shaped spinner is fixed to the shank, the reversing member being nested in the spinner with the shank extending through a hole in the reversing member and into the ratchet mechanism, the diameter of the spinner being approximately the same as that of the working end of the handle for easy engagement by the gripping hand of the user to spin the shank relative to the handle. A spacer fixed to the shank cooperates with the spinner to limit axial movement of the reversing member.

21 Claims, 1 Drawing Sheet

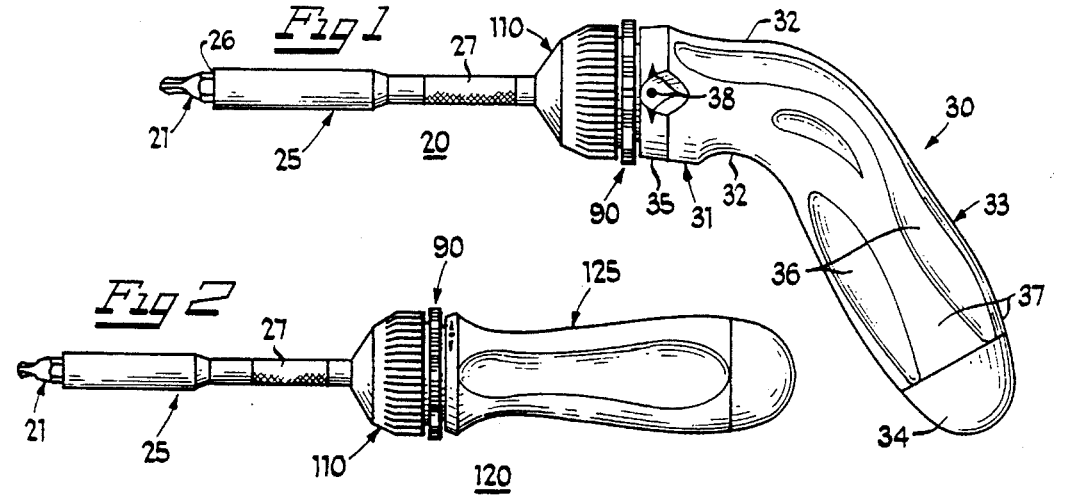
Fig 1
26
27
110
32
38
30
21
25
20
90
35
31
32
33
36
37
34
Fig 2
90
125
27
21
25
110
120
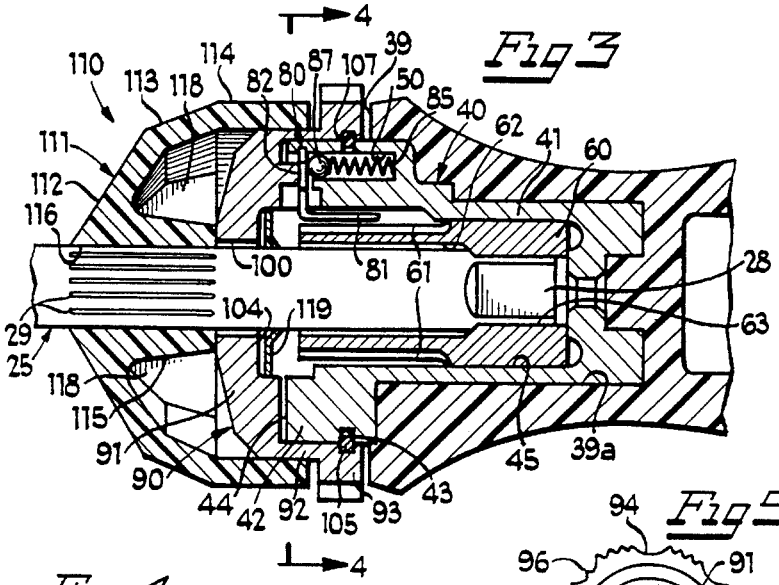
Fig 3
4
110
113
118
114
82
80
87
107
39
50
85
40
62
41
60
111
112
116
100
81
61
28
29
25
104
119
63
118
115
91
90
44
42
92
105
93
43
45
39a
4
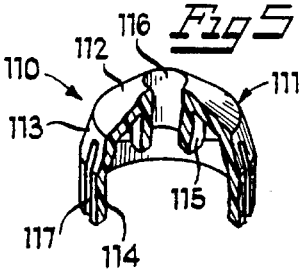
Fig 5
116
112
110
111
113
115
117
114
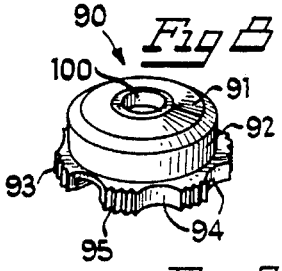
Fig 8
90
100
91
92
93
94
95
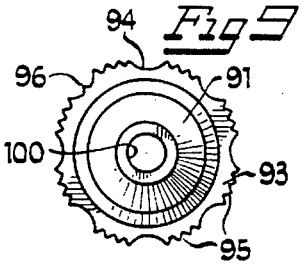
Fig 9
94
96
91
100
93
95
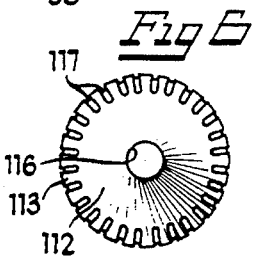
Fig 6
117
116
113
112
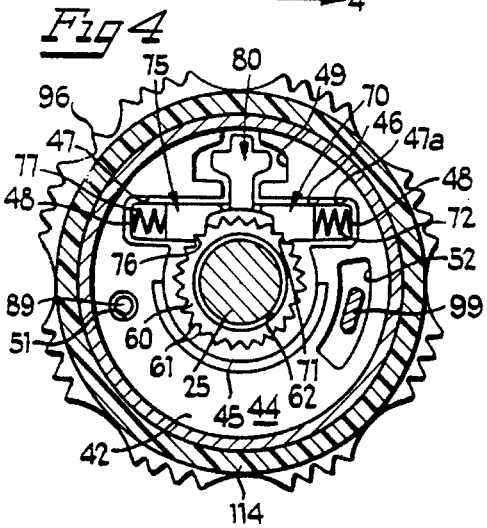
Fig 4
75
80
49
96
70
46
47
47a
77
48
48
72
76
52
89
99
51
60
61
25
71
62
45
44
42
114
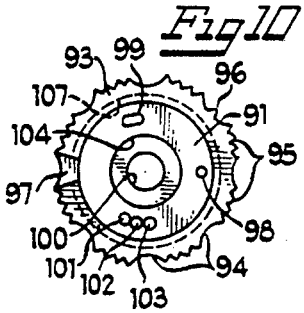
Fig 10
93
99
96
107
91
104
95
97
98
100
101
102
103
94
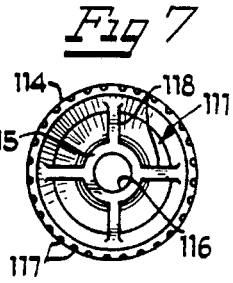
Fig 7
114
118
111
115
116
117

REVERSIBLE RATCHETING SCREWDRIVER WITH SPINNER AND ERGONOMIC HANDLE

BACKGROUND OF THE INVENTION

1. Field of the Invention

This invention relates to ratcheting drivers of the type used for driving screws, nuts and the like and, in particular, to reversible ratcheting drivers.

2. Description of the Prior Art

The present invention is an improvement of the reversible ratcheting screwdriver disclosed in U.S. Pat. No. 4,777,852, the disclosure of which is incorporated herein by reference. That screwdriver has an elongated handle and a ratchet mechanism carried by a working end of the handle. The ratchet mechanism includes a gear engageable with a pair of pawls, the gear having an axial bore which receives one end of an associated shank. A control cap surrounds the ratchet mechanism and receives the shank through an opening therein, the cap being retained in place by a split ring and being rotatable to actuate a reversing mechanism to shift the ratchet mechanism among forward and reverse ratcheting modes and a non-ratcheting mode. The control cap has a knurled outer circumferential surface which has a maximum outer diameter substantially the same as that of the working end of the handle. The shank has a knurled portion so that a user, while gripping the handle with one hand, can spin the shank relative to the handle by grasping the knurled portion of the shank with the other hand. Such a spinning operation is utilized during low-resistance portions of the driving operation of an associated fastener, such as during the early stages of tightening a fastener or the late stages of loosening a fastener.

This prior arrangement is inconvenient, because it requires that the user employ both hands in order to effect the spinning operation of the shank. Also, the prior ratcheting screwdriver has a standard elongated straight handle. This arrangement can make it difficult and uncomfortable for the user to apply high torquing forces to an associated fastener or other type of workpiece, since it affords a very small moment arm for the torquing force application. Also, because this configuration requires the user's wrist to be extended in an unnatural manner, applications which require repeated operations over long periods of time can be physically tiring and/or painful for a user's wrist.

SUMMARY OF THE INVENTION

It is a general object of this invention to provide an improved ratcheting screwdriver which avoids the disadvantages of prior ratcheting screwdrivers while affording additional structural and operating advantages.

An important feature of the invention is the provision of a ratcheting screwdriver which permits both normal driving operation and spinning of the screwdriver shank with the use of a single hand of the operator.

A still further feature of the invention is to provide a ratcheting screwdriver of the type set forth, which has an ergonomically designed handle.

Yet another feature of the invention is to provide a ratcheting screwdriver of the type set forth which is reversible and permits both reversing and spinning operations to be performed by the same hand of the operator which grasps the handle.

Still another feature of the invention is the provision of a reversible ratcheting screwdriver of the type set forth, which is of relatively simple and economical construction.

These and other features of the invention are attained by providing in a ratcheting screwdriver including a handle having a generally cylindrical working end with a predetermined diameter, ratchet mechanism carried by the working end of the handle, the ratchet mechanism defining a bore having an axis, an elongated shank receivable coaxially in the bore and engageable with the ratchet mechanism for rotation with the handle in response to rotation of the handle in one direction and for ratcheting rotation relative to the handle in response to rotation of the handle in the opposite direction, the improvement comprising: a generally cup-shaped spinner fixed to the shank coaxially therewith and having a maximum outer diameter approximately the same as the predetermined diameter, the spinner being disposed adjacent to the working end of the handle for operation by a finger and/or thumb of a user's hand for spinning the shank relative to the handle while the hand is grasping the handle.

Further features of the invention are attained by providing in a ratcheting screwdriver including a handle having a generally cylindrical working end with a predetermined diameter, a reversible ratchet mechanism carried by the working end of the handle and operable in forward and reverse ratcheting modes, the ratchet mechanism defining a bore having an axis, and an elongated shank receivable coaxially in the bore and engageable with the ratchet mechanism for rotation with the handle in response to rotation of the handle in a forward direction and for ratcheting rotation relative to the handle in response to rotation of the handle in a reverse direction when the ratchet mechanism is in its forward ratcheting mode, and for rotation with the handle in response to rotation of the handle in a reverse direction and for ratcheting rotation relative to the handle in response to rotation of the handle in a forward direction when the ratchet mechanism is in its reverse ratcheting mode, the improvement comprising: a generally cup-shaped spinner fixed to the shank coaxially therewith and having a maximum outer diameter approximately the same as the predetermined diameter, and a cylindrical reversing member disposed between the spinner and the handle for rotation relative to the shank, the reversing member having an outer diameter approximately the same as the predetermined diameter and being engageable with the ratchet mechanism for shifting it between its forward and reverse ratcheting modes in response to rotation of the reversing member, each of the spinner and the reversing member being disposed closely adjacent to the working end of the handle for operation by a finger and/or thumb of a user's hand while the hand is grasping the handle for spinning the shank relative to the handle and/or shifting the mode of the ratchet mechanism.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there are illustrated in the accompanying drawings preferred embodiments thereof, from an inspection of which, when considered in connection with the following description, the invention, its construction and operation, and many of its advantages should be readily understood and appreciated.

FIG. 1 is a side elevational view of a reversible ratcheting screwdriver in accordance with a first embodiment of the present invention;

FIG. 2 is a view similar to FIG. 1, on a slightly reduced scale, of a ratcheting screwdriver in accordance with another embodiment of the present invention;

FIG. 3 is an enlarged, fragmentary, sectional view of the ratchet and reversing mechanisms of the screwdrivers of FIGS. 1 and 2;

FIG. 4 is a view in vertical section taken along the line 4—4 in FIG. 3;

FIG. 5 is an enlarged, perspective view in partial section of the spinner of the screwdrivers of FIGS. 1 and 2;

FIG. 6 is a front elevational view of the spinner of FIG. 5;

FIG. 7 is a rear elevational view of the spinner of FIG. 5;

FIG. 8 is a perspective view of the reversing ring of the screwdrivers of FIGS. 1 and 2;

FIG. 9 is a front elevational view of the reversing ring of FIG. 8; and

FIG. 10 is a rear elevational view of the reversing ring of FIG. 8.

DESCRIPTION OF THE PREFERRED EMBODIMENTS

Turning now to the drawings and, more particularly, to FIG. 1 thereof, there is depicted a ratcheting screwdriver 20 incorporating the features of the present invention. The screwdriver 20 carries a removable bit 21 for use in driving a Phillips® screw. Various designs of bits well known in the industry may be substituted for the bit shown. The screwdriver 20 includes a shank 25 having an enlarged end defining a receptacle 26 for the bit 21. Within the receptacle 26 is a magnet (not shown) to which the bit 21 is attracted and thereby removably held. The shank 25 has a portion with a knurled surface 27 to facilitate gripping by the user. Referring also to FIG. 3, the shank 25 is circular in cross section along most of its length but has a square end 28 opposite the receptacle 26. Longitudinally extending knurls or splines 29 may be provided on the shank 25 a slight distance axially from the square end 28 for a purpose to be described below.

The shank 25 is mounted in an elongated handle 30 which is bent generally into a "pistol grip " configuration. More specifically, the handle 30 has a short forward portion 31 which extends along a first axis and is coupled by a necked-down bend portion 32 to an elongated grip portion 33, which extends along a second axis inclined at an angle of approximately 120° C. to the axis of the forward portion 31. The distal end of the grip portion 33 is provided with a cap or cover 34 which may be unscrewed to expose a compartment (not shown) in which bits may be stored. The forward portion 31 of the handle 30 terminates in a working end 35. The grip portion 33 has four slightly concave surfaces 36 separated by four convex surfaces 37, which design facilitates gripping of the handle 30. On the working end 35 are indicia 38 consisting of a pair of oppositely directed arrows and a dot between the arrows. Each arrow signifies that the screwdriver 20 is rotated in that direction and is ratcheted in the opposite direction. The center dot signifies the position in which the screwdriver 20 functions without any ratcheting. The working end 35 has a substantially circular end surface 39 in which is formed an axial bore **39*a* (FIG. 3**).

Referring to FIGS. 3 and 4, the handle 30 carries a reversible ratchet assembly 40 which is essentially the same as that disclosed in U.S. Pat. No. 4,777,852. In particular, a metal insert 41 is mounted in the bore **39*a* in the forward portion 31 of the handle 30. The handle 30 is preferably constructed of high impact plastic and the insert 41 is molded in place. The sides of the insert 41 define flange-like elements (not shown) to enable secure retention in the plastic handle. The insert 41 has an enlarged forward end portion 42 about which a circumferential groove 43 is provided, used for locking purposes as will be described. Referring also to FIG. 4, the forward end portion 42 has a circular end surface 44 in which is formed an axial bore 45 which is generally cylindrical in shape and the axis of which is collinear with the longitudinal axis of the forward portion 31 of the handle 30. The insert 41 also has a keyway 46 which communicates with the bore 45 and is generally tangent thereto. The keyway 46 has arm portions 47 and 47*a* on opposite sides of the bore 42. The ends of the keyway 46 are defined by two end surfaces 48 which face each other and are generally parallel to each other and to the axis of the bore 45. A generally cruciform recess 49 is also formed in the end surface 44. In the bottom surface of the recess 49 is an axially extending hole 50. An axially extending hole 51 is formed in the end surface 44 but spaced from the hole 50 about 100° C. An arcuate slot 52 is formed in the surface 44 and extends approximately from 90° C. to 135° C. removed from the hole 50**.

The ratchet assembly 40 further comprises a tubular gear 60 which is generally cylindrical and is located in the bore 45 and is freely rotatable therein. The forward half of the gear 60 has a multiplicity of teeth 61. Extending axially through the tubular gear 60 is an opening 62, the forward portion of which is cylindrical and the rear end of which is square. The shank 25 extends into the opening 62 and the square end 28 mates with the square end 63 of the opening 62. Accordingly, the shank 25 is fixed to the tubular gear 60 so as to rotate therewith.

The ratchet assembly 40 further includes a pawl 70 which has the shape generally of a parallelepiped, except that one edge is replaced with axially extending teeth 71, which teeth have a shape to mesh with the teeth 61 on the tubular gear 60. The pawl 70 is located in the keyway portion **47*a* (FIG. 4). A spring 72 is located between the pawl 70 and the adjacent one of the end surfaces 48. The spring 72 biases the pawl 70 to the left, as viewed in FIG. 3, against the tubular gear 60. The ratchet assembly 40 further comprises a second pawl 75 which has a construction identical to that of the pawl 70. Its teeth 76 are designed also to mesh with the teeth 61 of the tubular gear 60. A spring 77, identical to the spring 72, is disposed between the pawl 75 and the left hand one of the end surfaces 48. The pawl 75 is biased to the right, as viewed in FIG. 4 against the tubular gear 60**.

The pawls 70 and 75 and the gear 60 are configured and operated in a manner to achieve forward and reverse ratcheting modes of operation, as well as a non-ratcheting mode of operation. When the pawls 70 and 75 are both engaged with the tubular ratchet gear 60, as illustrated in FIG. 4, the screwdriver 20 is in a non-ratcheting mode of operation and operates as a standard screwdriver. If the pawl 70 is disengaged, so that only the pawl 75 remains engaged with the tubular gear 60, then rotation of the handle 30 in a forward direction (counterclockwise, as viewed in FIG. 4) will result in rotation of the shank 25 with the handle to torque the associated fastener, whereas when the handle 30 is rotated in the opposite direction it ratchets relative to the shank 25. Conversely, when only the pawl 70 is engaged with the tubular gear 60, the handle 30 drives the shank 25 when it is rotated in a reverse direction (clockwise, as viewed in FIG. 4), and ratchets relative to the shank 25 when it is rotated in the opposite direction. The details of these modes of operation are explained in the aforementioned U.S. Pat. No. 4,777,852 and, therefore, will not be further described herein.

In order to move the pawls 70 and 75 between their engaged and disengaged positions, there is provided a reversing mechanism which includes an actuator 80. The actuator 80 is generally L-shaped, having a lever 81 and an engagement portion 82. The lever 81 extends rearwardly into the keyway 46 between the pawls 70 and 75. The engagement portion 82 is generally cruciform so as to define a radially directed leg and a laterally directed leg. A spring 85 is located in the hole 50, which biases a ball 87 forwardly and against the engagement portion 82 and specifically against the central area thereof. A spring (not shown) is located in the hole 51, which biases a ball 89 forwardly (FIG. 4).

Referring also to FIGS. 8–10, the reversing mechanism also includes a reversing ring 90, which is a generally cup-shaped member, preferably formed of metal, which has a generally circular end wall 91 integral at its outer edge with a cylindrical skirt or side wall 92. The opposite end of the side wall 92 is integral with a radially outwardly extending annular flange 93, which is provided with arcuate flutes 94 in its outer surface at circumferentially spaced-apart locations, the outer surface of the flange 93 being knurled or serrated, as at 95, between the flutes 94. Also formed in the outer surface of the flange 93 is an indicator projection 96 (FIG. 9). A radial slot or opening 97 is formed through the flange 93 at one of the flutes 94 (FIG. 10). The sides of the slot 97 preferably flare outwardly as shown. Unitary with the end wall 91 at arcuately spaced locations are a pin 98 and a lug 99 which project from the inner surface of the end wall 91. An axial bore 100 is formed through the end wall 91. Part-spherical detent recesses 101, 102 and 103 are formed in the inner surface of the end wall 91, as is an annular recess 104, which coaxially encircles the inner end of the axial bore 100. The side wall 92 has an inner diameter slightly greater than the outer diameter of the forward end 42 of the metal insert 41 so as to be receivable telescopically thereover. A circumferential groove or recess 107 is formed in the distal end face of the flange 93 at the junction with the side wall 92 for receiving a split-ring retaining spring 105, which is also seated in the groove 43 in the metal insert 41 (FIG. 3) for retaining the reversing ring 90 on the insert 41, as will be explained more fully below.

The ratcheting screwdriver 20 also includes a spinner cap 110, which is a generally cup-shaped member having a compound forward wall 111 which includes a forward frustoconical portion 112 and a rear frustoconical portion 113, the latter joining a cylindrical side wall 114. Unitary with the forward frustoconical portion 112 and projecting rearwardly therefrom is a substantially cylindrical hub 115 having an axial bore 116 formed therethrough. A plurality of circumferentially spaced- apart gripping grooves 117 are formed in the outer surfaces of the cylindrical side wall 114 and the rear frustoconical portion 113 of the forward wall 111. Internally of the cap 110, four equiangularly spaced-apart stiffening ribs 118 extend between the hub 115 and the forward wall 111. The rear end of the hub 115 terminates substantially at the forward end of the cylindrical side wall 114. The inner diameter of the cylindrical side wall 114 is slightly greater than the outer diameter of the side wall 92 of the reversing ring, so as to be telescopically receivable thereover.

In assembly of the ratcheting screwdriver 20, the square end of the shank 25 is first fitted through the axial bore 116 in the spinner cap 110 from front to rear, the splines 29 on the shank 25 being so dimensioned as to provide a press-fit in the hub 115 for fixedly securing the spinner cap 110 to the shank 25. Alternatively, the spinner cap 110 could be molded in place on the shank 25. Next, the square end 28 of the shank 25 is fitted from front to rear through the axial bore 100 in the reversing ring 90, which nests within the spinner cap 110 as illustrated in FIG. 3, the depth of insertion being limited by engagement of the end wall 91 with the hub 115. The parts are so dimensioned that, when thus assembled, the distal edge of the cylindrical side wall 114 of the spinner cap 110 is preferably spaced a very slight distance from the flange 93 of the reversing ring 90 so that the two parts are freely rotatable relative to each other. A lock washer 119 (FIG. 3) is then fitted over the square end 28 of the shank 25 and is received in the annular recess 104 in the reversing ring 90 for cooperation with the hub 115 to axially position the reversing ring 90 on the shank 25.

Next, the retaining spring 105 is seated in the groove 43 of the metal insert 41 and the reversing ring 90 is fitted over the forward end 42 of the metal insert 41. It will be appreciated that the retaining spring 105 has radially extending end portions (not shown) which can be compressed together with the use of a needle-nosed pliers to pull the ring tightly into the groove 43 and allow the reversing ring 90 to be fitted thereover until the spring 105 seats in the reversing ring groove 107. In this regard, the opening 97 in the flange 93 permits access to the spring ends by the pliers. When the spring 105 is released, it expands to seat partially in the metal insert groove 43 and partially in the reversing ring groove 107 for retaining the reversing ring 90 on the metal insert 41 while accommodating relative rotational movement thereof.

It will be appreciated that, as the reversing ring 90 is fitted over the metal insert 41, the square end 28 of the shank 25 is received in the opening 62 of the tubular gear 60 and engages in the square rear end 63 thereof, as illustrated in FIG. 3. When the reversing ring 90 is mounted in place, it is rotationally oriented so that the pin 98 engages the engagement portion 82 of the reversing actuator 80, the lug 99 engages in the arcuate slot 52 to limit rotational movement of the reversing ring 90, the ball 89 seats in the detent recess 102 and the indicator channel 96 aligns with the center indicium dot on the working end 35 of the handle 30. The parts will thus be assembled in the configuration illustrated in FIGS. 3 and 4, with the ratchet assembly 40 disposed in its non-ratcheting mode.

The operation of the ratcheting screwdriver 20 is substantially as was described in the aforementioned U.S. Pat. No. 4,777,852, with the exception of the manipulation of the reversing actuator 80 and the spinning of the shank 25. It will be appreciated that a user will grasp the grip portion 33 of the handle for rotating the handle 30 about the axis of the shank 25. It is a significant aspect of the invention that, because of the pistol-grip configuration of the handle 30, substantial leverage can be exerted for torquing an associated fastener. Also, the pistol grip configuration permits the user to operate the screwdriver 20 substantially with his wrist aligned with his forearm in an ergonomically comfortable manner. It is a further significant aspect of the invention that the outer diameters of the reversing ring flange 93 and the spinner cap side wall 114 are approximately the same as that of the working end 35 of the handle 30. Thus, while the user is grasping the handle 30, he can extend either his thumb and/or a finger of the grasping hand to reach the flange 93 for rotating it to shift the operational mode of the ratchet assembly 40, and/or to spin the spinner cap 110. Thus, it is not necessary for the operator to utilize his other hand to spin the shank 25 (although he could do so if desired, by grasping either the spinner cap 110 or the knurled surface 27 of the shank 25). The fluting and the knurling or serrations on the flange 93 will facilitate operation of the reversing ring 90 and the grooves 117 will facilitate gripping the spinner cap 110. In this regard, the knurled or serrated outer surface portions of the flange 93 extend radially outwardly a slight distance beyond the peripheral outer surfaces of the cylindrical side wall 114 of the spinner cap 110 and the working end 35 of the handle 30, as can best be seen in FIGS. 3 and 4, to facilitate gripping by the thumb and/or forefinger of the user.

Referring to FIG. 2, there is illustrated a ratcheting screwdriver 120 which is substantially the same as the ratcheting screwdriver 20 of FIG. 1, except that it has a straight handle 125 of the same type which is disclosed in the aforementioned U.S. Pat. No. 4,777,852. Otherwise, the construction and operation of the ratcheting screwdriver 120 are identical to those of the ratcheting screwdriver 20, described above.

In a constructional model of the invention, the spinner cap 110 is preferably formed of a suitable plastic material, as are the handles 30 and 125, while the remaining parts of the screwdrivers are formed of suitable metals.

From the foregoing, it can be seen that there has been provided an improved reversible ratcheting screwdriver which is of simple and economical construction and ergonomic design and which permits both actuation of the reversing mechanism and spinning of the shank with the same hand used to grip the handle.

We claim:

1. In a ratcheting driver including a handle having a generally cylindrical working end with a predetermined diameter, ratchet mechanism carried by the working end of the handle, the ratchet mechanism defining a bore having an axis, an elongated shank receivable coaxially in the bore and engageable with the ratchet mechanism for rotation with the handle in response to rotation of the handle in one direction and for ratcheting rotation relative to the handle in response to rotation of the handle in the opposite direction, the improvement comprising: a generally cup-shaped spinner fixed to the shank coaxially therewith and having a maximum outer diameter approximately the same as the predetermined diameter, said spinner being disposed adjacent to the working end of the handle for operation by a finger and/or thumb of a user's hand for spinning the shank relative to the handle while the hand is grasping the handle.

2. The screwdriver of claim 1, and further comprising means for coupling said spinner to the handle.

3. The ratcheting screwdriver of claim 2, wherein said means for coupling includes a ring disposed between said spinner and the handle, and means retaining said ring on the working end of the handle coaxially therewith for accomodating limited relative rotation thereof while preventing relative axial movement thereof.

4. The ratcheting screwdriver of claim 1, wherein said spinner has an axial opening therein receiving the shank therethrough in press-fitted frictional engagement therewith.

5. In a ratcheting driver including a handle having a generally cylindrical working end with a predetermined diameter, a reversible ratchet mechanism carried by the working end of the handle and operable in forward and reverse ratcheting modes, the ratchet mechanism defining a bore having an axis, and an elongated shank receivable coaxially in the bore and engageable with the ratchet mechanism for rotation with the handle in response to rotation of the handle in a forward direction and for ratcheting rotation relative to the handle in response to rotation of the handle in a reverse direction when the ratchet mechanism is in its forward ratcheting mode, and for rotation with the handle in response to rotation of the handle in a reverse direction and for ratcheting rotation relative to the handle in response to rotation of the handle in a forward direction when the ratchet mechanism is in its reverse ratcheting mode, the improvement comprising: a a generally cup-shaped spinner fixed to the shank coaxially therewith and having a maximum outer diameter approximately the same as the predetermined diameter, and a cylindrical reversing member disposed between said spinner and the handle for rotation relative to the shank, said reversing member having an outer diameter approximately the same as the predetermined diameter and being engageable with the ratchet mechanism for shifting it between its forward and reverse ratcheting modes in response to rotation of said reversing member, each of said spinner and said reversing member being disposed closely adjacent to the working end of the handle for operation by a finger and/or thumb of a user's hand for spinning the shank relative to the handle and/or shifting the mode of the ratchet mechanism while the hand is grasping the handle.

6. The ratcheting driver of claim 5, wherein said reversing member is rotatable about said axis and includes peripheral portions extending different radial distances from said axis.

7. The ratcheting driver of claim 6, wherein one of said portions extends a slight distance radially outwardly beyond the working end of the handle and said spinner to facilitate engagement by a finger and/or thumb of a user's hand.

8. The ratcheting screwdriver of claim 5, and further comprising a spacer fixed to the shank and cooperating with said spinner for inhibiting axial movement of said reversing member relative to the shank.

9. The ratcheting screwdriver of claim 8, and further comprising a retaining member engageable with said reversing member and with the ratchet mechanism for retaining said reversing member and the shank on the handle.

10. The ratcheting driver of claim 5, wherein said reversing member is rotatable about said axis and includes a plurality of circumferentially spaced-apart peripheral portions each extending radially outwardly beyond the outer surfaces of the working end of the handle and said spinner.

11. The ratcheting driver of claim 10, wherein each of said portions has a serrated outer surface.

12. The ratcheting screwdriver of claim 5, wherein said handle has a grip portion with a second axis inclined at a predetermined angle with respect to the axis of the ratchet mechanism bore generally in a pistol grip configuration to provide an ergonomic shape.

13. In ratcheting driver including a handle having a generally cylindrical working end with a predetermined diameter, a reversible ratchet mechanism carried by the working end of the handle and operable in forward and reverse ratcheting modes, the ratchet mechanism defining a bore having an axis, and an elongated shank receivable coaxially in the bore and engageable with the ratchet mechanism for rotation with the handle in response to rotation of the handle in a forward direction and for ratcheting rotation relative to the handle in response to rotation of the handle in a reverse direction when the ratchet mechanism is in its forward ratcheting mode, and for rotation with the handle in response to rotation of the handle in a reverse direction and for ratcheting rotation relative to the handle in response to rotation of the handle in a forward direction when the ratchet mechanism is in its reverse ratcheting mode, the improvement comprising: a generally cup-shaped reversing member having an axial hole therein for receiving the shank therethrough and a radially outwardly extending annular flange with an outer diameter approximately the same as the predetermined diameter, said reversing member being engageable with the ratchet mechanism for shifting the ratchet mechanism between is forward and reverse ratcheting modes in response to rotation of said reversing member, and a generally cup-shaped spinner fixed to the shank coaxially therewith and having an open end disposed adjacent to said flange and nestably receiving said reversing member therein with the shank received through said hole, said reversing member being dimensioned for free rotation relative to said spinner and to the shank with said flange projecting radially slightly beyond said spinner, each of said spinner and said reversing member flange being disposed closely adjacent to the working end of the handle for operation by a finger and/or thumb of a user's hand for spinning the shank relative to the handle and/or shifting the mode of the ratchet mechanism while the hand is grasping the handle.

14. The ratcheting screwdriver of claim 13, wherein said reversing member has a cylindrical side wall and a circular end wall closing said side wall at one end thereof with said flange being disposed at the other end of said side wall, said hole being formed through said end wall.

15. The ratcheting screwdriver of claim 14, and further comprising a spacer fixed to the shaft and cooperating with said spinner for inhibiting axial movement of said reversing member relative to the shaft.

16. The ratcheting screwdriver of claim 15, wherein said end wall of said reversing member has a recess therein for receiving said spacer.

17. The ratcheting screwdriver of claim 13, wherein said spinner has a cylindrical hub portion fixed to the shank and limiting the depth of insertion of said reversing member therein.

18. The ratcheting screwdriver of claim 13, wherein said spinner is frictionally press-fitted on the shank.

19. The ratcheting screwdriver of claim 13, wherein said handle has a grip portion with a second axis inclined at a predetermined angle with respect to the axis of the ratchet mechanism bore generally in a pistol grip configuration to provide an ergonomic shape.

20. The ratcheting screwdriver of claim 19, wherein said predetermined angle is in the range of from about 100° to about 140°.

21. The ratcheting screwdriver of claim 13, wherein said flange has a fluted external surface for facilitating engagement by a user's finger and/or thumb.

* * * * *